US008020378B2

(12) United States Patent
LaBarge et al.

(10) Patent No.: US 8,020,378 B2
(45) Date of Patent: Sep. 20, 2011

(54) EXHAUST MANIFOLD COMPRISING ALUMINIDE

(75) Inventors: William J. LaBarge, Bay City, MI (US); Conrad Anderson, Davison, MI (US); Joachim Kupe, Davisburg, MI (US)

(73) Assignee: Umicore AG & Co. KG, Hanau (DE)

( * ) Notice: Subject to any disclaimer, the term of this patent is extended or adjusted under 35 U.S.C. 154(b) by 0 days.

(21) Appl. No.: 11/025,095

(22) Filed: Dec. 29, 2004

(65) Prior Publication Data

US 2006/0137333 A1 Jun. 29, 2006

(51) Int. Cl.
*F01N 7/10* (2006.01)

(52) U.S. Cl. ..... 60/323; 60/274; 60/299; 60/321; 29/890.08

(58) Field of Classification Search ..... 60/274, 60/282, 299, 300, 321, 323; 29/890, 890.08
See application file for complete search history.

(56) References Cited

U.S. PATENT DOCUMENTS

| | | | | |
|---|---|---|---|---|
| 3,851,470 | A * | 12/1974 | Kaufmann, Jr. | 60/298 |
| 3,907,708 | A | 9/1975 | Lacroix | |
| 3,935,705 | A * | 2/1976 | Hergoualch | 60/302 |
| 4,134,860 | A | 1/1979 | Hindin et al. | 252/466 PT |
| 4,188,309 | A * | 2/1980 | Volker et al. | 60/302 |
| 4,650,519 | A | 3/1987 | Chang et al. | 75/246 |
| 4,847,044 | A | 7/1989 | Ghosh | 419/8 |
| 4,961,903 | A | 10/1990 | McKamey et al. | 420/79 |
| 5,051,392 | A | 9/1991 | Mabilon et al. | |
| 5,098,469 | A | 3/1992 | Rezhets | 75/249 |
| 5,144,800 | A | 9/1992 | Shioya et al. | |
| 5,204,302 | A * | 4/1993 | Gorynin et al. | 502/2 |
| 5,238,752 | A | 8/1993 | Duderstadt et al. | 428/623 |
| 5,300,157 | A | 4/1994 | Okabe et al. | |
| 5,332,554 | A * | 7/1994 | Yasaki et al. | 422/180 |
| 5,386,696 | A * | 2/1995 | Prigent et al. | 60/300 |
| 5,466,311 | A | 11/1995 | Hu et al. | 148/513 |
| 5,512,250 | A | 4/1996 | Betta et al. | |
| 5,626,692 | A | 5/1997 | Rohatgi et al. | 148/538 |
| 5,692,373 | A | 12/1997 | Atmur et al. | 60/274 |
| 5,830,822 | A | 11/1998 | Euzen | 502/355 |
| 5,857,328 | A | 1/1999 | Blanchet et al. | 60/302 |
| 5,897,966 | A | 4/1999 | Grossklaus, Jr. et al. | 428/652 |
| 5,922,409 | A | 7/1999 | McMordie et al. | 427/383.7 |
| 5,958,829 | A | 9/1999 | Domesle et al. | |

(Continued)

FOREIGN PATENT DOCUMENTS

EP 0591938 A1 4/1994

(Continued)

OTHER PUBLICATIONS

Yamabe-Mitarai et al.; "Platinum Group Metals Base Refractory Superalloys"; Materials Research Society Symposium Proceedings, Proceedings of the 1996 MRS Fall Meeting, Dec. 2-5, 1996; Abstract Only; 1 page.

(Continued)

*Primary Examiner* — Tu Nguyen
(74) *Attorney, Agent, or Firm* — Smith, Gambrell & Russell, LLP

(57) ABSTRACT

An exhaust manifold includes an exhaust conduit having an inner surface, and an aluminide layer disposed on at least a portion of the inner surface of the manifold. The exhaust manifold is made by applying aluminum on an inner surface of the manifold and oxidizing to form the aluminide layer.

20 Claims, 1 Drawing Sheet

U.S. PATENT DOCUMENTS

| | | | | |
|---|---|---|---|---|
| 5,975,852 | A | 11/1999 | Nagaraj et al. | 416/241 R |
| 6,062,020 | A | 5/2000 | Blanchet et al. | 60/302 |
| 6,066,291 | A | 5/2000 | Chen et al. | 420/445 |
| 6,069,111 | A * | 5/2000 | Yamamoto et al. | 502/333 |
| 6,153,313 | A | 11/2000 | Rigney et al. | 428/632 |
| 6,245,447 | B1 | 6/2001 | Nazmy et al. | 428/633 |
| 6,254,756 | B1 | 7/2001 | Maricocchi et al. | 205/97 |
| 6,254,842 | B1 | 7/2001 | Hu et al. | 423/213.5 |
| 6,256,984 | B1 * | 7/2001 | Voss et al. | 60/299 |
| 6,273,678 | B1 | 8/2001 | Darolia | 415/200 |
| 6,283,714 | B1 | 9/2001 | Rigney et al. | 416/241 R |
| 6,283,715 | B1 | 9/2001 | Nagaraj et al. | 416/241 R |
| 6,294,140 | B1 | 9/2001 | Mussmann et al. | 423/213.5 |
| 6,425,964 | B1 | 7/2002 | Deevi et al. | |
| 6,614,033 | B2 | 9/2003 | Suguro et al. | 250/491.1 |
| 6,681,890 | B1 * | 1/2004 | Chen et al. | 181/291 |
| 6,725,656 | B2 * | 4/2004 | Moore et al. | 60/323 |
| 6,852,276 | B2 * | 2/2005 | Kim | 420/96 |
| 2001/0049936 | A1 | 12/2001 | Kenneth et al. | |
| 2002/0179275 | A1 | 12/2002 | Blum et al. | |
| 2004/0115104 | A1 * | 6/2004 | Iizuka et al. | 422/177 |
| 2006/0216415 | A1 * | 9/2006 | Olson et al. | 427/237 |

FOREIGN PATENT DOCUMENTS

| | | | |
|---|---|---|---|
| EP | 145608 | A2 | 8/2004 |
| WO | WO 93/23581 | | 11/1993 |
| WO | 99/56853 | A1 | 11/1999 |

OTHER PUBLICATIONS

Tanaka; "Research and Development of Ultra-High Temperature Materials in Japan"; Materials of High Temperatures, vol. 17, No. 4, 2000 Sci. Technol Letters, pp. 457-464; Abstract Only, 1 page.

Ono, et al.; "Effect of Ir Addition on the High-Temperature Creep Strength of B2-Type NiAI Intermetallic Compounds"; Journal of Japan Institutes of Metals, vol. 64, No. 11, 2000 Japan Inst. Of Metals, pp. 1048-1055; Abstract Only; 1 page.

Poruchikov et al.; "Technological Characteristics of Phosphatic Materials for Semi-Permanent Molds"; Soviet Castings Technology, No. 6, 1989, pp. 31-34, Abstract Only, 1 page.

Kishi, "Development of the Ultra Low Heat Capacity and Highly Insulating (ULOC) Exhaust Manifold for ULEV"; SAE Special Publications, Proceedings of the 1998 SAE International Congress & Exposition, Feb. 23-26, 1998; Abstract Only; 1 page.

Day; "ATTAP Extruded Ceramic Regenerator Disk Development"; Proceedings—Society of Automotive Engineers, Proceedings of the Annual Automotive Technology Development Contractors' Coordination Meeting; Oct. 28-31, 1991; Abstract Only; 1 page.

Li et al.; "Thin Film Coatings of $(Ca_{0.6},Mg_{0.4})Zr_4(PO_4)_6$ on $Si_3N_4$ and SiC"; Journal of Material Research, vol. 9, No. 8, Aug. 1994, Abstract Only, 1 page.

Wrigley, "Chrysler Eyes Switch to Aluminized"; American Metal Market (USA), vol. 101, No. 46, pp. 2 & 16, Mar. 10, 1993; Abstract Only, 1 page.

Wrigley; "Cadillac to Use Stainless"; American Metal Market (USA), vol. 101, No. 209, p. 6, Oct. 28, 1993, Abstract Only, 1 page.

Japanese Patent JP 20042415 A2; Issued Date: Feb. 15, 2000; Abstract Only; 1 page.

Japanese Patent JP 20140642 A2; Issued Date: May 23, 2000; Abstract Only; 1 page.

Japanese Patent JP 8281116 A2; Issued Date: Oct. 29, 1996; Abstract Only; 1 page.

Carolyn Krause; "Nickel Aluminides: Breaking into the Marketplace"; http://www.ornl.gov/ORNLReview/rev28-4/text/nickel.htm; Aug. 23, 2001; 6 pages.

"ORNL's Iron Aluminides: An Emerging Success Story"; http://www.ornl.gov/ORNL_Review/rev28-4/text/iron.htm; Aug. 23, 2001; 2 pages.

Christopher J. Tennant; "Exhaust Emissions Formulation in Spark Ignited Engines"; File://A:\Emiss_SI.htm; 1 page.

Stiller et al.; "Platinum Aluminde Diffusion Coatings on Nickel-Base Alloys for Gas Turbines; Effect of Different Factors on the Useful Life of Coatings"; http://www.htc.chalmers.se/projects/project3.htm; Abstract Only; 1 page; Aug. 18, 2001.

Fairbank, et al.; "Ultra-High Temperature intermetallics for the third Millennium"; Aug. 21, 2001; Abstract Only; 1 page.

Monceau et al.; "Transition in High-Temperature Oxidation Kinetics of Pd-Modified Aluminde Coatings: Role of Oxygen Partial Pressure, Heating Rate, and Surface Treatment"; http://www.mrs.org/publications/jmr/jmra/2000/mar/014.htm; Abstract Only; 1 page.

Itoh et al.; "Development of Ferritic Stainless Steel Foil as Metal Support for Automotive Catalytic Converter"; Nippon Technical Steel Report, No. 64, pp. 69-74, Jan. 1995, Abstract Only, 1 page.

Hiramatsu et al.; "The Effect of Lanthanum on the Scales Developed on Thin Foils of Fe-20Cr-5AI at Very High Temperatures"; Oxidation of Metals, 51 (5/6); pp. 479-494, Jun. 1999, Abstract Only, 1 page.

Pint et al.; "Analytical Electron-Microscopy Study of the Breakdown of α-AI2O3 Scales Formed on Oxide Dispersion-Strengthened Alloys"; Oxidation of Metals; 56 (1/2); pp. 119-145, Aug. 2001, Abstract Only, 1 page.

Shemet et al.; "The Formulation of Protective Alumina-Based Scales During High-Temperature Air Oxidation of γ—TiAI Alloys"; Oxidation of Metals; 54 (3/4); pp. 211-235, Oct. 2000, Abstract Only, 1 page.

An et al.; "Effect of the θ-α-AI2O3 Transformation in Scales on the Oxidation Behavior of a Nickel-Base Superalloy with an Aluminide Diffusion Coating"; Oxidation of Metals, 54 (3/4); pp. 301-316, Oct. 2000, Abstract Only, 1 page.

Frangini, "Corrosion Behavior of AISI 316L Stainless Steel and ODS FeAI Aluminide in Eutectic Li2CO3-K2CO3 Molten Carbonates under Flowing CO2-O2 Gas Mixtures"; Oxidation of Metals, 53 (1/2); pp. 139-156, Feb. 2000, Abstract Only, 1 page.

Stönner et al.; "Characterization and Oxidation of Magnetron Sputtered Fe-AI Intermetallic Alloys"; Hyperfine Interactions, 112 (1/4); pp. 155-160, 1998; Abstract Only, 1 page.

Mohamed et al.; Article in Press; "Kinetics and Mechanism of Formation of Tricalcium Aluminate, $Ca_3AI_2O_6$"; Thermochimica Acta 6944 (2002) 1-10; www.elsevier.com/locate/tca; Oct. 18, 2001, 10 pages.

http://www.alt2csp.com/index2.htm, Technical Bulletin, "Manufacturing/Coating Microstructure", AK Steel, Jul. 2001, 2 pages.

* cited by examiner

EXHAUST MANIFOLD COMPRISING ALUMINIDE

BACKGROUND OF THE INVENTION

Known combustion catalysts are usually prepared from a monolithic substrate of ceramic or metal on which a fine layer of catalyst support material consisting of refractory metal oxides, usually aluminum oxide, and promoter oxides, usually rare earth oxides, are deposited.

Catalytic converters containing washcoated substrate are located downstream of the exhaust manifold in what is known to those skilled in the art as underfloor, close coupled or manifold mounted converters. The exhaust gas from a defect free engine contains roughly equivalent amounts of reducing species (carbon monoxide and hydrocarbons) and oxidizing species (nitrogen oxides). The reducing species are preferentially consumed by chemical reduction of the oxidizing species, resulting in exhaust emissions below established Federal and State limits. However, vehicles that have degraded fuel control, e.g., heavily aged vehicles and/or vehicles having used poor quality fuels, may emit much more reducing species than oxidizing species. Exothermic combustion of high concentrations of reducing species may lead to premature deactivation of the catalytic converter before the vehicle reaches the required 125,000 mile durability. Prevention of the excess hydrocarbon from reaching the underfloor catalytic converter is greatly preferred.

During the combustion of exhaust gas catalytic converters are often subjected to exhaust gas temperatures reaching 800° C. and higher. Exothermic combustion reactions often increase the 800° C. exhaust gas temperature to above 1,050° C. on the catalyst bed. As vehicles age and fuel control worsens, catalyst bed temperatures may exceed 1,200° C. In particular, thermal cycling of combustion catalysts above 1,100° C. degrades the low temperature catalytic activity. Possible causes for the degradation of low temperature performance include sintering of the catalyst support, catalyst erosion, and vaporization and encapsulation of the active precious metal phase(s). For example, catalyst beds that have reached more than 1,100° C. very often do not begin catalytic combustion until exhaust temperatures reach above about 450° C. Since the exhaust stream is at or below 500° C. for a significant amount of time, the amount of pollutants emitted greatly increases when the low temperature combustion activity lost.

There remains a need for improved exhaust treatment devices, systems, and methods.

SUMMARY

Disclosed herein are exhaust manifolds comprising an aluminide layer disposed therein, as well as methods of making and using the exhaust manifold of the manifold. In one embodiment, the exhaust manifold can comprise: an exhaust conduit having an inner surface, and an aluminide layer disposed on at least a portion of the inner surface.

In one embodiment, the method for making the exhaust manifold can comprise oxidizing aluminum on an inner surface of the manifold to form the aluminide layer.

The above-described and other features are exemplified by the following figures and detailed description.

BRIEF DESCRIPTION OF THE DRAWINGS

Refer now to the figures, which are meant to be exemplary, not limiting, and wherein like elements is numbered alike.

DETAILED DESCRIPTION

It is noted that the terms "first," "second," and the like, herein do not denote any amount, order, or importance, but rather are used to distinguish one element from another, and the terms "a" and "an" herein do not denote a limitation of quantity, but rather denote the presence of at least one of the referenced item. Additionally, all ranges disclosed herein are inclusive and combinable (e.g., the ranges of "up to 25 wt %, with 5 wt % to 20 wt % desired," are inclusive of the endpoints and all intermediate values of the ranges of "5 wt % to 25 wt %," etc.). As used herein the term "about", when used in conjunction with a number in a numerical range, is defined being as within one standard deviation of the number "about" modifies.

In order to inhibit sintering and limit the drop in the specific surface area of the downstream catalyst, the exhaust manifold may be catalyzed for hydrocarbon combustion. Specifically, an aluminide layer can be disposed (e.g., grown) on the exhaust manifold (e.g., on the inside walls thereof), and the aluminide layer can be catalyzed with a platinum group metal. Desirably, the aluminide coating does not impede heat transfer from the exhaust gas to the manifold, therefore, it does not insulate the conduit. Insulation could prevent heat loss through the conduit to the environment and increase the thermal deactivation of the downstream catalytic converter.

For example, a catalyzed aluminide coating has been demonstrated effective for combustion of most of the hydrocarbons emitted due to a single clogged fuel injector. A single clogged fuel injector only increases the amount of hydrocarbon exhausted from one individual cylinder. After the exhausted hydrocarbon stream comes out of an exhaust port, it travels several inches through a small conduit that contains only the exhaust from one engine cylinder. Downstream, (e.g., often at about six inches or so from the exhaust port of the engine cylinder), all the individual conduits (branches) are combined into one larger conduit (combined conduit) (collectively known as an exhaust manifold). Combustion of hydrocarbons is much more efficient if it is accomplished as a concentrated stream, e.g., before dilution with exhaust gas from the other cylinders. Therefore, it is desirable to remove the hydrocarbons (e.g., combust the hydrocarbons) in the single conduit (branch) before exhaust gasses from all the individual branches, i.e., cylinders are mixed together.

Figure 1:
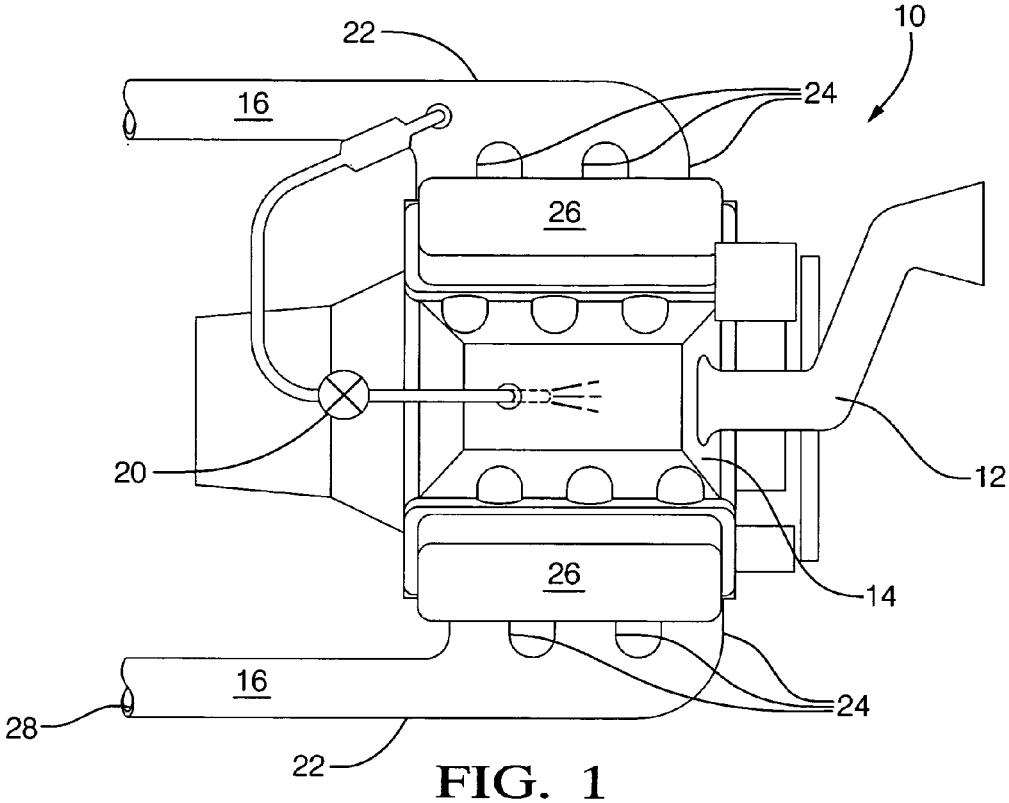
FIG. 1 is a diagram of an exemplary exhaust gas re-circulation (EGR) system.

Disclosed herein is an exhaust manifold having a conduit with an aluminide, e.g., an aluminide scale, on at least a portion of an inner surface of the conduit. Optionally, an active catalyst material disposed at the aluminide scale. An exemplary exhaust gas re-circulation (EGR) system 10 is depicted in FIG. 1. The EGR system 10 generally includes an air inlet tube 12, an intake manifold 14, an exhaust manifold 16, an optional passageway 18 connected between the exhaust manifold 16 and the intake manifold 14, and an EGR valve 20 is interposed in the passageway 18 for controlling re-circulation of exhaust gas into the intake manifold 14. The exemplary exhaust gas manifold 16 comprises combined manifold conduit 22. The combined manifold conduit 22 comprises individual manifold branches 24 that mount the exhaust manifold 16 to an exhaust side of an engine cylinder head 26.

The combined manifold conduit 22 and individual manifold branches 24 can comprise any material capable of withstanding the exhaust temperatures and conditions (e.g., regular operating temperatures of about 400° C. to about 800° C., and exposure to exhaust constituents (e.g., hydrocarbons (HC), carbon monoxide (CO), carbon dioxide ($CO_2$), nitrogen oxides (NOx), water ($H_2O$), sulfur oxides (SOx), particulate matter (e.g., soot, and the like), and the like)). Although some ferritic stainless steels can be employed, due to the consistently high temperatures, cast metal (e.g., cast iron, and the like) is generally desired.

Figure 2:
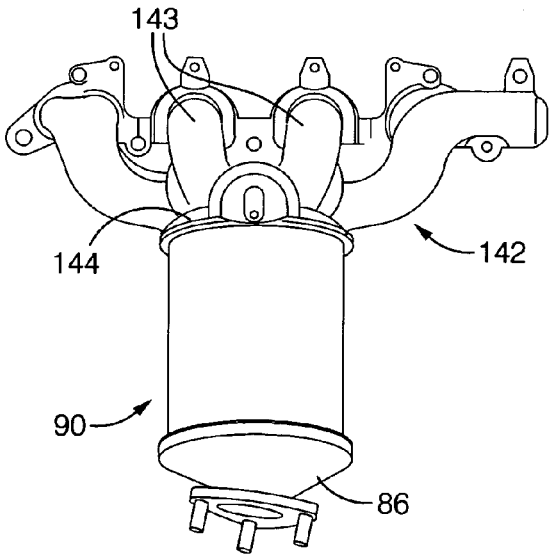
FIG. 2 is a frontal view of an exemplary manifold with manifold mounted converter.
Figure 3:
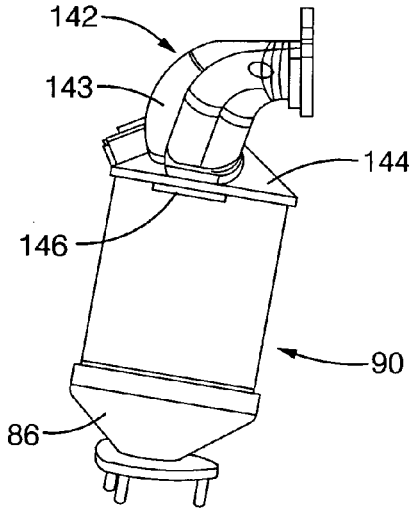
FIG. 3 is a frontal view of an exemplary manifold with manifold mounted converter.

Referring now to FIGS. 2 and 3, exhaust manifolds are shown. An exhaust manifold 142, as shown in a front view in FIG. 2 and a side view in FIG. 3, is designed to collect exhaust gases exiting the cylinders of an engine. Exhaust manifold 142 comprises a collection of pipes or conduits 143, whose number corresponds with the number of cylinders in the engine, which upon exiting the engine compartment, are bent and directed to a single conduit leading to a catalytic converter 90, having an end plate 86 connected to an exhaust pipe. An exhaust manifold collector body 144 having a plurality of pipes or runners can place exhaust manifold 142 in contact with catalytic converter 90 creates a manifold/converter.

Disposed on at least a portion of an interior surface of the individual manifold branches 143 and collector body 144 is an aluminide that is catalytic for combustion of hydrocarbons. The catalytic aluminide preferably comprises as the catalytic element platinum, rhodium, palladium, ruthenium, and combinations comprising at least one of the foregoing, or, more specifically, platinum aluminide and optionally, rhodium aluminide, palladium aluminide, ruthenium aluminide, and combinations comprising at least one of the foregoing.

The catalytic aluminide can optionally comprise the catalytic element disposed on and/or in (referred to herein as "on") an aluminide, such as platinum metal disposed upon pure aluminide scale. The catalytic aluminide can optionally comprise the catalytic element disposed on an intermetallic aluminide such as platinum metal disposed upon iron aluminide. The aluminide scale can be derived from aluminum contained within the metallurgical content of the conduit and/or can be formed from aluminum deposited on the inner surface of the conduit. Aluminum may be disposed onto the conduit by any number of techniques. Despite the technique, however, prior to disposing the aluminum metal onto the conduit, the surface of the substrate can be prepared. For example, a cast iron manifold may be cleaned by sand blasting the surface with 400 grit, SiC abrasive.

The exposed aluminide surface does not have to have the same concentration of catalytic element throughout. For example, at the exhaust gas-aluminide interface, the aluminum concentration can be less than or equal to about 16 wt %, while at the manifold-aluminide interface the aluminum concentration can be greater than or equal to about 72 wt %. Low aluminum concentration at the gas phase interface allows good catalytic oxidation. High aluminum concentration at the manifold interface allows good aluminide adhesion and durability.

To further enhance the adhesion of catalytic aluminide to the manifold (e.g., steel manifold), it is desirable to dispose a small amount of aluminum intermetallic compound at the interface between the steel manifold and the aluminide. Possible aluminum intermetallics include aluminum combined with additional material(s), such as nickel (nickel-aluminide), iron (iron-aluminide), titanium (titanium aluminide), niobium (niobium aluminide), and the like, and combinations comprising at least one of the foregoing additional materials.

To further enhance the catalytic activity of the catalytic aluminide, additional catalytic material(s) may be present in a non-aluminide form. Preferably the additional catalytic materials comprise platinum, palladium, rhodium, ruthenium, and the like, and combinations comprising at least one of the foregoing additional catalytic material(s). The inclusion of platinum is particularly desirable. For example, a platinum aluminide scale can be additionally activated with platinum metal deposited over the platinum aluminide layer.

The amount of additional catalytic material(s) can be an amount sufficient to be catalytically active at temperatures above about 325° C. For example, when the additional catalytic material(s) are platinum and/or rhodium, the total platinum and/or rhodium concentration can be about 0.4 wt % to about 2.0 wt %, based upon the total weight of the platinum (rhodium) and platinum aluminide. When the additional catalytic material(s) are palladium and/or ruthenium, the palladium and/or ruthenium concentration can be about 2.0 wt % to about 8.0 wt %, based upon the total weight of the palladium (ruthenium) and platinum aluminide. Where the active aluminide material includes additional catalytic material(s), the additional catalytic material(s) can form a coating on the aluminide scale having a thickness of about 0.2 micrometers (μm) to about 8.0 μm, or, more specifically, about 0.2 μm to about 3.0 μm, or, even more specifically, about 0.2 μm to about 0.6 μm.

The aluminum intermetallic can be prepared prior to disposing (e.g., depositing), it on the conduit. Here, the aluminum intermetallic can be prepared by combining aluminum powder and the additional metal powder(s). For example nickel (Ni) and aluminum (Al) powders can be ball milled together to form an alloy comprising about 28 atomic percent (at. %) Ni and 72 at. % Al. After preparing the aluminum intermetallic, the aluminum intermetallic can be applied to the conduit as a powder forming an aluminum intermetallic-coated conduit. The aluminum intermetallic may be applied by any operable technique, e.g., slurry coating, electrostatic powder deposition, reaction synthesis processing, physical vapor deposition, chemical vapor deposition, electroplating, and the like. The intermetallic alloy/exhaust manifold may be heated in various atmospheres to aid in the inter-diffusion of the alloy into the exhaust manifold. Preferably, after heat cycling to greater than or equal to about 650° C., an oxidized intermetallic (such as nickel aluminide) forms at the manifold inner surface (e.g., in the conduit). A preferred intermetallic comprises a nickel-aluminide layer having a thickness of about 1 micrometers (μm) to about 3 μm.

Once the aluminum is disposed at the inner surface of the conduit (e.g., in the form of aluminum and/or an aluminum intermetallic), and/or if the aluminum is derived from the conduit, the aluminide scale can be formed. Forming the aluminide scale comprises annealing (e.g., diffusion annealing in, for example, a reducing or neutral atmosphere) to form a bond with the conduit surface. Diffusion annealing can be accomplished, for example, by heating in a dry, inert (e.g., argon) atmosphere with moisture levels of less than or equal to about 10 parts per million by weight (ppm), and then cooling to room temperature. Desirably, the annealing temperature is about 600° C. to about 1,000° C., or, more specifically, about 700° C. to about 950° C., and, even more specifically, about 750° C. to about 850° C. Diffusion annealing times can be about 10 minutes to about 240 minutes, or, more specifically, about 30 minutes to about 160 minutes, and, even more specifically, about 50 minutes to about 80 minutes. After annealing, the aluminum can be oxidized with air and moisture to form the aluminide scale, e.g., with the intermetallic element(s) desirably stabilizing the aluminide grain boundaries. Desirably, the oven ramp rate is controlled to obtain a substantially uniform, crack-free aluminide coating. For example, the oven ramp can be less than or equal to about 5° C./minute, or, more specifically, about 3° C./minute.

If the aluminum is derived from the conduit, optionally, the aluminum surface layer can be alloyed with additional metal (s) to forming an aluminum intermetallic. In particular, it is desirable that the metal cast manifold be cast from an iron-aluminum intermetallic alloy, thereby forming a cast iron-aluminide manifold; e.g., about 83.8 at. % iron, 16.0 at. % aluminum, and 0.2 at. % carbon, based upon the total atomic percent of the manifold. The addition of carbon allows precipitation of two phases of intermetallic, e.g. iron aluminide and iron-aluminum-carbide. It has been found that the dual phase manifold (e.g., iron-aluminide exhaust manifold) is more robust to failure than the single phase (e.g., iron-aluminide) manifold.

The aluminum oxide scale can then doped with an additional (e.g., catalytic) material(s) such as platinum, rhodium, palladium, ruthenium, or a combination comprising at least one of the foregoing materials. Preferably, the iron-aluminide manifold doped with additional metal is diffusion annealed and re-oxidized. The diffusion annealing allows diffusion of the additional metal (e.g. platinum) from the surface of the aluminide scale into the depth of the aluminide scale. The aluminide scale prevents the catalytic material, (e.g., platinum), from aggregating into large inactive grains. However, it is not necessary that all the additional metal be converted to an aluminide phase. For example, the existence of platinum metal particles dispersed throughout a platinum-aluminide matrix is an acceptable outcome of the diffusion annealing and oxidation process. In general, the doping element comprises, on average, an amount of from about 1.5 wt % to about 7.5 wt % of the aluminide scale wherein weight percent is based on the total weight of the aluminide scale including the additional doping element.

The additional catalytic material(s) can be disposed on the substrate so as to form a concentration gradient. For example, the aluminide scale layer on the manifold can comprise primarily aluminum oxide at the manifold-scale interface and primarily additional catalytic material(s) (e.g., platinum) at the scale surface exposed to exhaust gasses. The concentration of additional material(s) at the manifold-aluminide interface can be, on average, an amount of about 0.1 wt % to about 8 wt % additional material(s), wherein weight percent is based on the total dry weight of the aluminum and additional material(s), or, more specifically, about 1 wt % to about 6 wt %, or, even more specifically, about 2 wt % to about 3 wt %. Additionally, the concentration of the additional material(s) at the exposed aluminide scale surface can be, on average, about 0.1 wt % to about 38 wt %, based upon the total dry weight of aluminide and additional material(s) at the exposed surface, or, more specifically, about 8 wt % to about 30 wt %, or, even more specifically, about 11 wt % to about 26 wt %, and, yet more specifically, about 14 wt % to about 18 wt %.

Although the amount of additional catalytic material(s) disposed on the conduit surface according to either of the above disclosed methods can vary depending on the amounts of aluminum and additional metals used, the type of conduit onto which the aluminum and additional metals are deposed, and on the method of deposition, in general the preferred aluminide scale can have a thickness of about 200 nanometers (nm) to about 3,000 nm, or, more specifically, about 300 nm to about 2,000 nm, and, even more specifically, about 400 nm to about 1,000 nm.

The additional catalytic material(s) can be applied to the aluminide scale via various techniques, such as chemical vapor deposition, liquid phase impregnation, slurry coating, inking, and the like, as well as combinations comprising at least one of the foregoing. For example, the additional catalytic material(s) can comprise a solution (desirably a weak basic solution), such that acidity of the slurry will not attack the interface between the substrate and the aluminide scale. The solution may contain an inorganic hydroxide (such as platinum hydroxide), an inorganic ammine (such as platinum diammine), an organometallic (such as platinum 2-ethylhexaanoate), an oxide (such as platinum oxide), a sulfide (such as platinum sulfide), and the like, as well as combinations comprising at least one of the foregoing, with the employment of platinum ammine hydroxide desirable. The additional catalytic metal (desirably, uniformly) coats the portion of the exhaust manifold that exhaust gas comes into contact with. The catalytic metal can have a thickness of about 50 nanometers (nm) to about 500 nm, or, more specifically, about 80 nm to about 300 nm, and, even more specifically, about 80 nm to about 120 nm.

The pH of the additional catalytic material(s) as a solution or slurry is preferably about 7.2 to about 11, or, more specifically, about 8 to about 10, and, even more specifically, about 8.4 to about 9.4. The pH of the slurry can be adjusted as by addition of an acid or base, as is desirable, such as by the addition of tetramethyl ammonium hydroxide (TMAH) and/or acetic acid (HAc).

Once the pH has been adjusted, the additional catalytic material(s) can be applied to at least a portion of the aluminide scale. For example, aluminide scaled substrate can be dipped into the slurry, and the excess slurry can be cleared, e.g., such as by vacuum and/or air (e.g. air knife). Alternatively, the coating can be applied to the catalyst support by a variety of techniques, including immersion, spraying, painting, and the like (e.g. spraying catalyst upon aluminide scaled metal foil). The amount of coating applied can vary depending upon the physical and chemical properties of the slurry, such as viscosity and pH, as well as the withdrawal rate.

Following the catalytic material coating process, the catalytic material/aluminide scale/manifold can be dried and calcined at a temperature sufficient to burn off reducing material. For example, at temperatures of about 550° C. to about 1,000° C., or, more specifically, about 620° C. to about 650° C., for up to about 4 hours. An exemplary catalyst includes a cast iron-aluminide exhaust manifold that has a platinum aluminide scale layer, and a doping of platinum metal.

Desirably, the calcined layer of the additional catalytic material(s) deposited by slurry, exhibits less than or equal to about 10 wt % erosion (based upon the total calcined weight of the slurry prior to any erosion), for greater than or equal to about 2,000 engine hours, or, more specifically greater than or equal to about 3,000 engine hours, and even more specifically, greater than or equal to about 4,000 engine hours. More desirably, the calcined layer exhibits less than or equal to about 30 wt % erosion (based upon the total calcined weight of the slurry prior to any erosion) for greater than or equal to about 4,000 engine hours, or, more specifically, less than or equal to about 20 wt % erosion for greater than or equal to about 4,000 engine hours, and even more specifically, less than or equal to about 10 wt % erosion for greater than or equal to about 4,000 engine hours.

The following examples are meant to be illustrative, not limiting.

EXAMPLES

Example 1

An Uncoated Exhaust Manifold

An exhaust manifold is metal cast from a molten iron and carbon. Upon cooling, the metal cast manifold comprises a single precipitated intermetallic, i.e., iron-carbide. A 4.66 inch (11.8 centimeter (cm)) round cordierite substrate was washcoated with a 3.6 g/in$^3$ (0.22 g/cm$^3$) loading comprising 3.0 wt. % lanthanum stabilized gamma-delta aluminum oxide. The lanthanum stabilized gamma-delta aluminum oxide catalyst was calcined in air at 600° C. for 4 hours. The calcined washcoated substrate was subsequently impregnated with a precious metal loading of 0.174 g/in$^3$ (0.012 g/cm$^3$) palladium nitrate. The palladium-aluminum oxide catalyst was calcined in air at 600° C. for 4 hours.

The 4.66 inch round catalytic substrate was placed in a converter shell and the catalytic converter was welded into the exhaust stream at a location four inches downstream of the manifold outlet. The manifold/catalytic converter assembly underwent 100 hours accelerated engine aging with aging performed on a gasoline engine dynamometer. The catalyst bed temperature averaging about 925° C. with a peak temperature of about 1,060° C. After dynamometer aging, the catalysts were evaluated on a vehicle using the standard North American Federal Test Procedure (FTP) driving cycle and the engine out and cumulative tail pipe emissions were measured. The percent conversions (e.g., percent (%) hydrocarbon (HC) conversion) were calculated from the engine out and tailpipe emissions. It was noted that there was no aluminide present on the inner surface of the manifold, even after the 100 hours of accelerated engine aging.

Example 2

Aluminide on Conduit Surface in an Exhaust Manifold

An exhaust manifold is metal cast from a molten mixture of iron and carbon. Upon cooling the metal cast manifold was coated with vapor deposited aluminum metal. The aluminum vapor contacted the cast iron manifold depositing the aluminum thereon. The aluminized manifold was heated to above 830° C. in an argon atmosphere for 20 minutes so that the aluminum atoms interdiffused with the iron manifold. 2.0 volume percent (vol. %) oxygen and 100 ppm moisture were introduced into the furnace at 830° C. The surface aluminum was fully oxidized in about 10 minutes, forming the desired aluminide scale layer. A catalytic metal such as platinum was deposited by physical vapor phase deposition over the aluminide. The manifold/catalytic converter assembly described in Example 1 was cut from the manifold of Example 1 and welded to the manifold of Example 2.

Example 3

Iron-aluminide Exhaust Manifold

An exhaust manifold was metal cast from a molten mixture of iron, aluminum, and carbon. Upon cooling the metal cast manifold comprised two precipitated intermetallics (i.e., iron-aluminide and iron-aluminum-carbide). The as cast manifold was heated to above 830° C. for 2 hours to enrich the manifold surface with an aluminide layer. A platinum layer was deposited over the aluminide layer by impregnation of platinum nitrate using water as the carrier. A gas containing 3 vol. % hydrogen and 97 vol. % nitrogen was used for reducing the platinum compound into platinum metal. The platinum/iron aluminide/manifold was heat treated in a vacuum furnace for 4 hours at a temperature of 850° C. to diffuse the platinum into the iron aluminide surface scale. The manifold/catalytic converter assembly described in Example 1 was cut from the manifold of Example 2 and welded to the manifold of Example 3.

Example 4

Iron-aluminide Exhaust Manifold

An exhaust manifold was metal cast from a molten mixture of iron, aluminum and carbon. Upon cooling the metal cast manifold comprised two precipitated intermetallics (i.e., iron-aluminide and iron-aluminum-carbide). The as cast manifold was heated to above 830° C. for 2 hours to enrich the manifold surface with an aluminide layer. A platinum layer about 400 nanometers (nm) thick was deposited over the aluminide layer by chemical vapor deposition of platinum acetylacetonate using nitrogen as a carrier gas. A gas containing 3 vol. % hydrogen and 97 vol. % nitrogen was used for reducing the organometallic into platinum metal. The platinum/iron aluminide/manifold was heat treated in a vacuum furnace for 4 hours at a temperature of 850° C. to diffuse the platinum into the iron aluminide surface scale.

TABLE 1

| FTP performance | | | |
|---|---|---|---|
| COMPONENT | % Hydrocarbon conversion | % Carbon monoxide conversion | % Nitrogen oxide conversion |
| Example 1 (close coupled converter; cast iron manifold). | 95 | 88 | 90 |
| Example 2 (close coupled converter; cast iron manifold with 3 μm platinum aluminide layer) | 97 | 89 | 88 |
| Example 3 (close coupled converter and cast iron manifold with 18 wt % platinum dispersed on aluminide) | 98 | 90 | 87 |

Referring now to Table 1 that illustrates the advantages of using a catalyzed aluminide manifold upstream of a close-coupled converter. The catalyst is the same in every example, so any difference in catalytic conversion is due to the changes to the manifold. It is apparent that the Example 3 (2 wt. % breakthrough, with the weight percent based on the grams of HC out of engine versus grams of HC out of tailpipe) with the platinum catalyzed aluminide has significantly higher conversion for HC in comparison to Example 1 (5 wt. % breakthrough). The HC breakthrough reduction is 60% (e.g. from 5 wt. % to 2 wt. %). As would be expected, poorer hydrocarbon conversion resulted in higher nitrogen oxide conversion. Example 2 also demonstrates a significant improvement (from 5 wt. % to 3 wt. %) of the hydrocarbon conversion HC in comparison to Example 1.

The aluminide scale formed according to the above disclosure, serves to improve catalytic material adhesion to the conduit, thereby minimizing catalytic material erosion losses during the lifetime of a exhaust manifold. Not to be limited by theory, it is believed that the intermetallic aluminide scale serves to inhibit and slow aluminide grain growth, and corrosion and oxidation damage at the surface of the substrate.

A primary measurement of a successful catalyst is that, after extended aging, the catalyst is still able to minimize polluting species below desired thresholds. Catalysts have not been included in the exhaust manifold 22 because of erosion of the catalyst materials and subsequent loss of catalyst activity during aging. The aluminide scale disclosed herein provides a layer that has increased anchoring and reduced erosion of active catalyst materials allowing reduced loadings of active catalyst materials, e.g., thinner layers of platinum enabling cost reductions.

The aluminide scale and exhaust manifold 22 have intimate bonding that exceeds the bonding typical between a catalyst and substrate. The additional catalytic materials are more strongly bonded to an aluminide coating than upon a substrate. Alternatively, in the absence of a catalyst support, the catalyst metals are deposited directly upon the aluminide scale layer. The catalyst metals are more strongly bonded to an aluminide coating than upon a substrate.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for making an exhaust manifold having an aluminide layer, comprising:

forming an exhaust manifold of cast iron, said exhaust manifold having an inner surface;

forming an aluminum intermetallic compound layer on and in direct contact with at least a portion of the inner surface of the exhaust manifold; and after the aluminum intermetallic compound layer is formed, forming a platinum aluminide layer on and in direct contact with said aluminum intermetallic compound layer.

2. The method of claim 1, wherein the manifold comprises a branch capable of feeding exhaust from an engine into a combined conduit, and wherein the platinum aluminide layer is disposed on an inner surface of the branch.

3. The method of claim 1, further comprising introducing an additional catalytic metal to the platinum aluminide layer.

4. The method of claim 1, wherein the aluminum intermetallic compound layer comprises nickel-aluminide.

5. The method of claim 1, wherein an additional catalytic element is present which is selected from the group consisting of platinum, rhodium, palladium, ruthenium and mixtures thereof.

6. The method according to claim 1, wherein the aluminum intermetallic compound layer contains aluminum combined with a member selected from the group consisting of nickel, iron, titanium, niobium and combinations thereof.

7. The method of claim 1, wherein the manifold has a metallurgy comprising an iron-aluminum intermetallic alloy.

8. The method of claim 7, wherein the manifold further comprises carbon.

9. An exhaust manifold, comprising:

an exhaust conduit formed of cast iron and having an inner surface;

an aluminum intermetallic compound layer disposed directly on at least a portion of the inner surface of the exhaust conduit; and a platinum aluminide layer disposed directly on at least a portion of the aluminum intermetallic compound layer, wherein the platinum aluminide layer is made by forming the platinum aluminide layer on the aluminum intermetallic compound layer directly after the aluminum intermetallic compound layer is formed.

10. The exhaust manifold of claim 9, wherein the platinum aluminide layer has a thickness of about 200 nm to about3, 000 nm.

11. The exhaust manifold of claim 9, wherein the thickness is about 300 nm to about 2,000 nm.

12. The exhaust manifold of claim 9, wherein the thickness is about 400 nm to about 1,000 nm.

13. The exhaust manifold of claim 9, wherein the manifold further comprises iron-aluminum-carbide.

14. The exhaust manifold of claim 9, wherein the aluminum intermetallic layer comprises an aluminide material selected from the group consisting of nickel-aluminide, iron-aluminide, titanium aluminide, niobium aluminide and mixtures thereof.

15. The exhaust manifold according to claim 9, wherein the aluminum intermetallic compound layer contains aluminum combined with a member selected from the group consisting of nickel, iron, titanium, niobium and combinations thereof.

16. The exhaust manifold of claim 9, wherein a metallurgy of the manifold comprises iron and aluminum.

17. The exhaust manifold of claim 16, wherein the metallurgy further comprises carbon.

18. The exhaust manifold of claim 9, further comprising an additional catalytic element in the platinum aluminide layer.

19. The exhaust manifold of claim 18, wherein the catalytic element is present in an amount of about 14 wt % to about 18 wt % platinum, based upon a total weight of the aluminide and catalytic element.

20. An exhaust manifold comprising:

an exhaust conduit formed of cast iron and having an inner surface;

an aluminum intermetallic compound layer disposed on and in direct contact with at least a portion of the inner surface of the exhaust conduit; and a platinum aluminide layer disposed on and in direct contact with at least a portion of the aluminum intermetallic compound layer;

wherein said exhaust manifold is made by forming an aluminum intermetallic compound layer on and in direct contact with at least a portion of the inner surface of the exhaust manifold, and directly thereafter forming a platinum aluminide layer on and in direct contact with said aluminum intermetallic compound layer.

* * * * *